US008011034B2

(12) United States Patent
Hoffman et al.

(10) Patent No.: US 8,011,034 B2
(45) Date of Patent: Sep. 6, 2011

(54) FOLDABLE SOFA-BED WITH FOLDING-ASSIST AND EXTENSION-ASSIST MECHANISMS

(75) Inventors: D. Stephen Hoffman, High Point, NC (US); Marcus L. Murphy, Lexington, NC (US); Douglas Gasal, Dallas, TX (US); Robert Barron Duncan, Harlingen, TX (US)

(73) Assignee: American Leather, Dallas, TX (US)

( * ) Notice: Subject to any disclaimer, the term of this patent is extended or adjusted under 35 U.S.C. 154(b) by 244 days.

(21) Appl. No.: 12/407,939

(22) Filed: Mar. 20, 2009

(65) Prior Publication Data

US 2009/0235452 A1 Sep. 24, 2009

Related U.S. Application Data

(60) Provisional application No. 61/038,252, filed on Mar. 20, 2008, provisional application No. 61/038,881, filed on Mar. 24, 2008.

(51) Int. Cl.
*A47C 17/04* (2006.01)

(52) U.S. Cl. ..... 5/38; 5/27; 5/37.1; 5/42

(58) Field of Classification Search ..... 5/13, 14, 5/27, 28, 29, 31, 32.1, 37.1, 38, 42, 42.1, 5/43, 44.1, 56, 57.1

See application file for complete search history.

(56) References Cited

U.S. PATENT DOCUMENTS

| | | | | |
|---|---|---|---|---|
| 2,740,131 | A * | 4/1956 | Vogel et al. | 5/42 |
| 3,508,283 | A * | 4/1970 | Dukellis et al. | 5/13 |
| 6,904,628 | B2 * | 6/2005 | Murphy et al. | 5/47 |
| 7,549,182 | B2 | 6/2009 | Murphy | |
| 2011/0010846 | A1 | 1/2011 | Murphy | |
| 2011/0010847 | A1 | 1/2011 | Murphy | |
| 2011/0018331 | A1 | 1/2011 | Murphy et al. | |

* cited by examiner

*Primary Examiner* — Robert G Santos
*Assistant Examiner* — Nicholas Polito
(74) *Attorney, Agent, or Firm* — Connolly Bove Lodge & Hutz LLP

(57) ABSTRACT

A sofa-bed includes: a frame with opposed arms; a backrest operatively connected to the frame; a seat; a subseat hinged to the seat and pivotable relative thereto; an extension-assist mechanism attached to the frame and at least one of the seat and the subseat; and a folding-assist mechanism attached to the frame and at least one of the subseat and seat. The frame, backrest, seat and subseat are configured to move between a folded position, in which the backrest is generally upright, the seat is generally horizontal, and the subseat is generally horizontal and positioned beneath the seat in a first inverted orientation, and an unfolded position, in which the backrest, subseat and seat are generally horizontal, and the subseat is positioned between the backrest and the seat in a second non-inverted orientation. The folding-assist mechanism is configured such that the sofa-bed is biased toward the folded position as the sofa-bed moves from the unfolded position toward a first intermediate position. Also, the extension-assist mechanism is configured such that the sofa-bed is biased toward the unfolded position as the sofa-bed moves from a second intermediate position toward the folded position.

17 Claims, 8 Drawing Sheets

FOLDABLE SOFA-BED WITH FOLDING-ASSIST AND EXTENSION-ASSIST MECHANISMS

RELATED APPLICATION

The present application claims priority from U.S. Provisional Patent Application Ser. Nos. 61/038,252, filed Mar. 20, 2008 and 61/038,881, filed Mar. 24, 2008, the disclosures of each of which are hereby incorporated by reference herein in their entireties.

FIELD OF THE INVENTION

The present invention relates generally to a sofa that is convertible into a bed, and relates more specifically to a sofa that has backrest and seat sections that form portions of the bed.

BACKGROUND OF THE INVENTION

Convertible sofa beds are popular with consumers because of their multifunctionality. Many consumers find it very convenient to have a sofa that can provide a bed for a guest, as such a sofa can eliminate the need for an additional, separate bed. One popular sofa-bed design includes its own complete mattress that is folded within the cavity of the sofa during periods of non-use. One such example is illustrated in U.S. Pat. No. 4,200,941 to Gill et al. This type of sofa-bed can be quite heavy, and typically requires not only the separate mattress, but also a relatively intricate mechanism to control the unfolding and folding of the mattress.

Other sofa beds lack a complete mattress, instead being constructed of separate sections that serve as support surfaces of the sofa and unfold to form a flat, mattress-like sleeping surface. An example of a convertible sofa of this type is illustrated in U.S. Pat. No. 4,737,996 to Tiffany. The Tiffany sofa-bed includes a backrest, a seat and a "subseat" that unfold to form the horizontal sleeping surface. In the folded "sofa" configuration, the backrest is generally upright, and the seat and "subseat" fold upon each other (with the subseat in an inverted position). The backrest is guided between positions by preformed slots in the arms of the sofa that receive posts that extend laterally from the backrest. The backrest is coupled to the seat and subseat via an angled link. The subseat is pivotally attached at one end to the arms and is hinged at the other end to the seat. This arrangement is described in Tiffany as being particularly economical and having relatively few moving parts.

Another example of the Tiffany bed is shown in U.S. Pat. No. 6,904,628 to Murphy et al., in which certain aspects of the Tiffany bed are improved, particularly related to the opening and closing of the bed. However, it may be desirable to continue to address areas of the Tiffany bed that can be improved.

SUMMARY OF THE INVENTION

As a first aspect, embodiments of the present invention are directed to a foldable sofa-bed. The sofa-bed comprises: a frame with opposed arms; a backrest operatively connected to the frame; a seat; a subseat hinged to the seat and pivotable relative thereto; an extension-assist mechanism attached to the frame and at least one of the seat and the subseat; and a folding-assist mechanism attached to the frame and at least one of the subseat and seat. The frame, backrest, seat and subseat are configured to move between a folded position, in which the backrest is generally upright, the seat is generally horizontal, and the subseat is generally horizontal and positioned beneath the seat in a first inverted orientation, and an unfolded position, in which the backrest, subseat and seat are generally horizontal, and the subseat is positioned between the backrest and the seat in a second non-inverted orientation. The folding-assist mechanism is configured such that the sofa-bed is biased toward the folded position as the sofa-bed moves from the unfolded position toward a first intermediate position. Also, the extension-assist mechanism is configured such that the sofa-bed is biased toward the unfolded position as the sofa-bed moves from a second intermediate position toward the folded position. In this configuration, the sofa-bed is assisted during folding during stages in the movement in which assistance is desirable, and resisted during stages in the movement in which resistance is desirable.

As a second aspect, embodiments of the present invention are directed to a sofa-bed comprising: a frame with opposed arms; a backrest operatively connected to the frame; a seat; a subseat hinged to the seat and pivotable relative thereto; and a backrest mechanism attached to the frame and to the backrest. The frame, backrest, seat and subseat are configured to move between a folded position, in which the backrest is generally upright, the seat is generally horizontal, and the subseat is generally horizontal and positioned beneath the seat in a first inverted orientation, and an unfolded position, in which the backrest, subseat and seat are generally horizontal, and the subseat is positioned between the backrest and the seat in a second non-inverted orientation. The backrest mechanism includes front and rear swing links, each of the front and rear swing links being pivotally interconnected with the frame and the backrest. This configuration can provide smooth movement of the backrest relative to the frame as the sofa-bed moves between positions.

As a third aspect, embodiments of the present invention are directed to a sofa-bed comprising: a frame with opposed arms; a backrest operatively connected to the frame; a seat; a subseat hinged to the seat and pivotable relative thereto; and a backrest mechanism attached to the frame and to the backrest. The frame, backrest, seat and subseat are configured to move between a folded position, in which the backrest is generally upright, the seat is generally horizontal, and the subseat is generally horizontal and positioned beneath the seat in a first inverted orientation, and an unfolded position, in which the backrest, subseat and seat are generally horizontal, and the subseat is positioned between the backrest and the seat in a second non-inverted orientation. The backrest mechanism includes a rear leg pivotally interconnected with the backrest and foldable between a folded position generally parallel with the backrest when the sofa-bed is in its folded position and an unfolded position generally perpendicular to the backrest when the sofa-bed is in its unfolded position. This configuration can give added support to the sofa-bed in the unfolded position.

DETAILED DESCRIPTION OF EMBODIMENTS OF THE INVENTION

Figure 1:
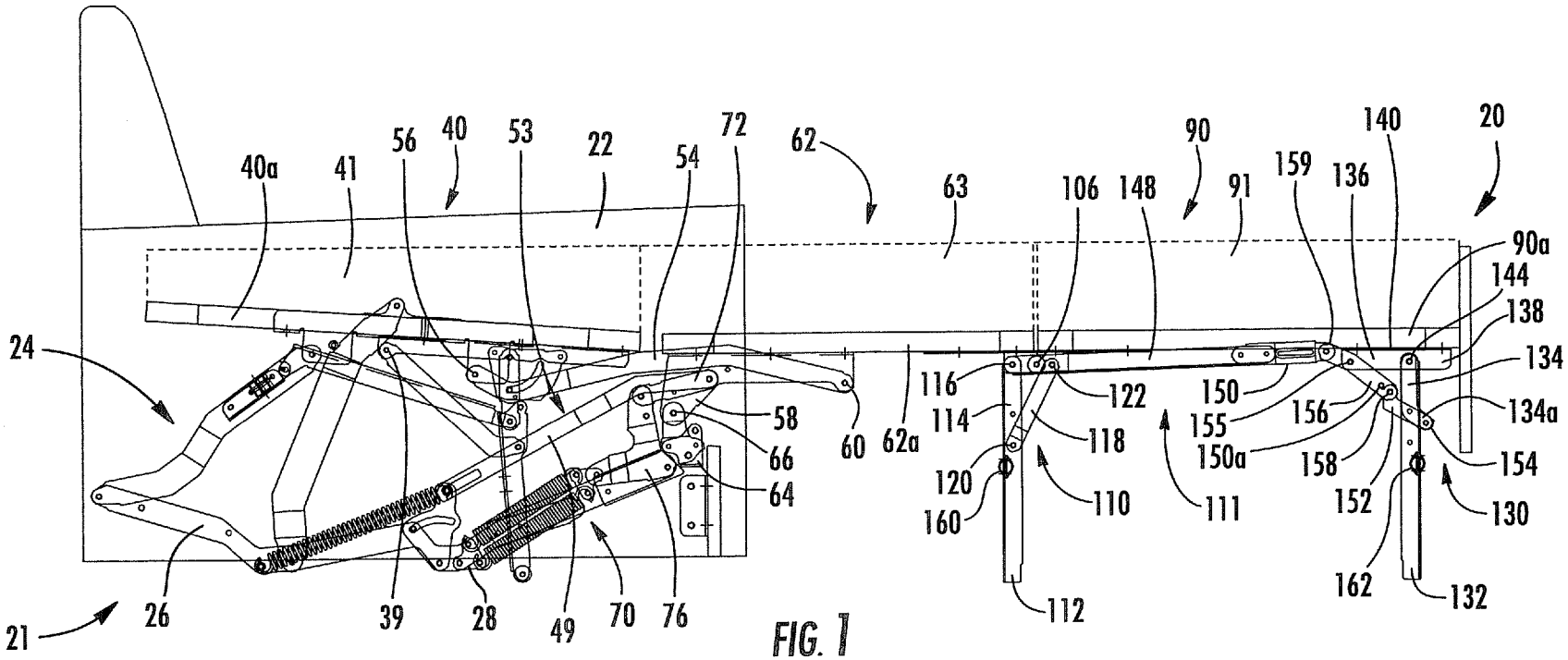
FIG. 1 is a side view of a sofa-bed according to embodiments of the present invention, in which the sofa-sleeper is shown in its unfolded position.
Figure 2:
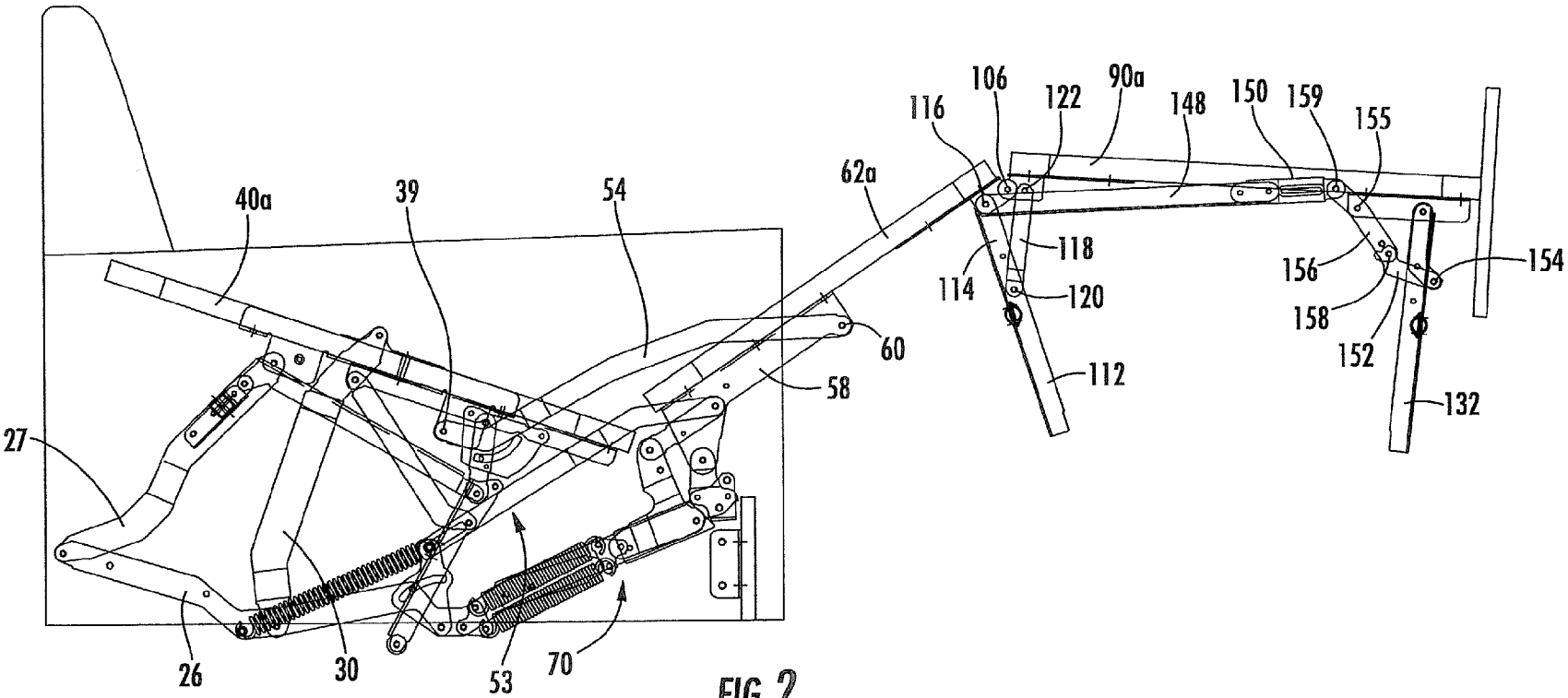
FIG. 2 is a side view of the sofa-bed of FIG. 1, with the sofa-bed shown moving toward the folded position from the unfolded position.

The present invention will be described more particularly hereinafter with reference to the accompanying drawings. The invention is not intended to be limited to the illustrated embodiments; rather, these embodiments are intended to fully and completely disclose the invention to those skilled in this art. Like numbers refer to like components throughout, and certain dimensions and thicknesses may be exaggerated for clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. As used herein the expression "and/or" includes any and all combinations of one or more of the associated listed items. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Where used, the terms "attached", "connected", "interconnected", "contacting", "mounted," "coupled" and the like can mean either direct or indirect attachment or contact between elements, unless stated otherwise. In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. The device may be otherwise oriented (rotated 90 degrees or at other orientations) and the descriptors of relative spatial relationships used herein interpreted accordingly.

Well-known functions or constructions may not be described in detail for brevity and/or clarity.

Referring now to FIGS. 1-5, a convertible sofa-bed, designated broadly at 20, is illustrated herein. The sofa-bed 20 includes a pair of generally upright rectangular arms 22, a backrest 40, a subseat 62, and a seat 90. Each of the backrest 40, subseat 62 and seat 90 includes a flat panel (designated at 40*a*, 62*a* and 90*a*, respectively) and an upholstered cushion (designated at 41, 63 and 91, respectively, and usually formed of a medium to high density foam) releasably (via a zipper or the like) or permanently fixed thereto (in many embodiments, a removable cushion (not shown) overlies the seat cushion 91 and is removed prior to the unfolding of the sofa-bed 20). These sections of the sofa-bed 20 are interconnected with a pair of connecting links 54 and a hinge 106 such that they can be converted from the sofa configuration illustrated in FIG. 4 to the bed configuration illustrated in FIG. 1.

The sofa bed 20 is essentially a pair of mirror images about a vertical plane P (see FIG. 5) that extends through the center of the backrest 40, the subseat 62, and the seat 90 equidistant between the arms 22. As such, except where indicated, only the structures on one side of the sofa-bed 20 is described herein in detail; those skilled in this art will understand that this description is equally applicable to the mirror image structures on the opposite side of the sofa-bed 20.

In addition, as used herein the terms "lateral", "outward" and derivatives thereof indicate the directions defined by a vector beginning at the aforementioned plane P and extending normal thereto. Conversely, the terms "inward", "inboard" and derivatives thereof indicate the direction opposite the "outward" direction. Together, the "inward" and "outward" directions comprise the "transverse" axis of the sofa-bed 20. The "rear" of the unfolded sofa-bed 20 is located at the end of the sofa-bed 20 nearest the backrest 40, and the "front" of the sofa-bed 20 is located at the end opposite the backrest 40. The "front" and "rear" directions comprise the "longitudinal" axis of the sofa-bed 20. The "head" of the unfolded sofa-bed 20 is the end formed by the backrest 40, and the "foot" of the unfolded sofa-bed 20 is the end formed by the seat 90.

In addition, some components of the sofa-bed 20 are illustrated herein as a series of pivotally interconnected links. Those skilled in this art will appreciate that the pivots between links can take a variety of configurations, such as pivot pins, rivets, bolt and nut combinations, and the like, any of which may be suitable for use with the present invention. Also, the shapes and configurations of the links themselves may vary as understood by those skilled in this art.

In the interest of clarity, the interconnection of the backrest 40, subseat 62 and seat 90 will be described in the unfolded position shown in FIGS. 1 and 6. Subsequently, the movement of the sofa-bed 20 between the unfolded and folded positions will be described.

Figure 6:
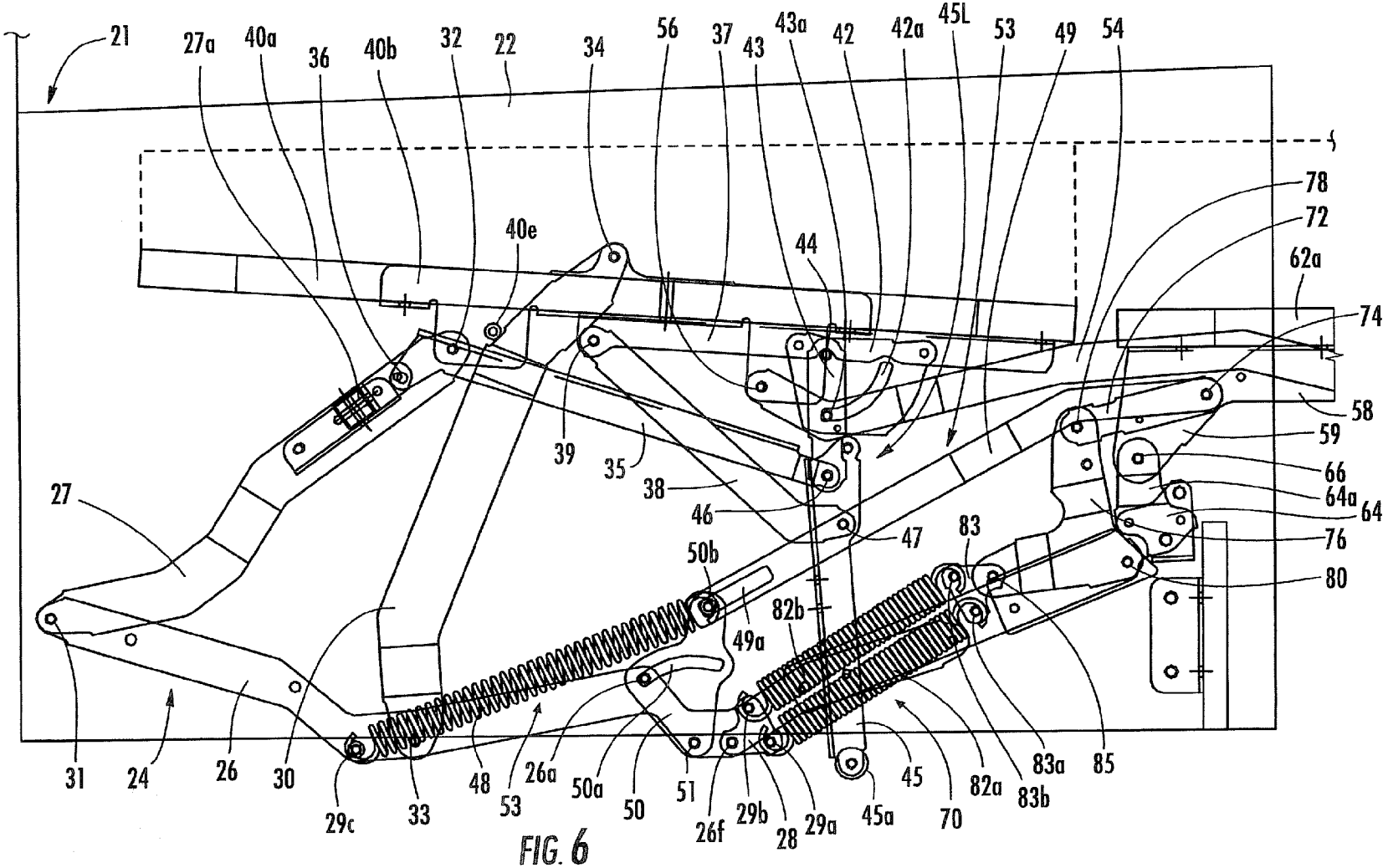
FIG. 6 is an enlarged side view of the sofa-bed of FIG. 1 shown in its unfolded position.

Turning now to FIGS. 1 and 6, the sofa-bed 20 includes a frame 21 that has arms 22 on opposite sides thereof. A backrest mechanism 24 is mounted on the inboard surface of each arm 22. The backrest mechanisms 24 are essentially mirror images of each other about the plane P; accordingly, only one backrest mechanism 24 will be described herein, with the understanding that the discussion is equally applicable to the backrest mechanism 24 on the opposite side of the sofa-bed 20.

As shown in FIGS. 1 and 6, a mounting bracket 26 is mounted to the arm 22 and extends generally longitudinally. The mounting bracket 26 has a spring extension 28 mounted to the front end thereof at a pivot 26*f*. The spring extension 28 has two pins 29*a*, 29*b* that are mounted generally side-by-side. A pin 29*c* is also mounted to a central portion of the mounting bracket 26. A rear swing link 27 is attached to the rear end of the mounting bracket 26 at a pivot 31 and extends upwardly and forwardly therefrom. A front swing link 30 is mounted to the mounting bracket 26 just forwardly of the pin 29*c* at a pivot 33. The front and rear swing links 30, 27 are mounted at respective pivots 32, 34 to a bracket 40*b* that is fixed to the lateral edge of the backrest panel 40*a*. The swing links 27, 30 control the movement of the backrest 40 as it moves between the folded and unfolded positions.

Still referring to FIG. 6, a support bracket 37 is mounted to the underside of the backrest panel 40*a*. A rear leg bracket 42 is mounted to the support bracket 37. An upper leg segment 43 is mounted to the rear leg bracket 42 at a pivot 44. A pin 43*a* mounted to the upper leg segment 43 is received in a slot 42*a* in the leg bracket 42. A lower leg segment 45 is attached to the lower end of the upper leg segment 43 at a pivot 46 and extends downwardly therefrom such that the upper and lower leg segments form a rear leg 45L that extends generally perpendicularly to the backrest 40. A wheel 45*a* is attached to the lower end of the lower leg segment 45. A brace 38 is mounted to a rear end of the support bracket 37 at a pivot 39 and extends forwardly and downwardly therefrom to terminate at a pivot 47 with the lower leg segment 45. The upper and lower leg segments 43, 45 are coupled to the rear swing link 27 via a coupling link 35, which is mounted at a pivot 36 to a cross-tube 27*a* that extends between the rear swing links 27 and extends forwardly therefrom to share the pivot 46 with the upper and lower leg segments 43, 45.

As shown in FIGS. 1 and 6, a subseat bracket 58 is mounted to the panel 62*a* of the subseat 62 opposite the cushion 63. The subseat bracket 58 is also pivotally mounted to the inboard surface of the arm 22 via a subseat mounting bracket 64 at a pivot 66 located on a downwardly-extending tab 59 on the subseat bracket 58. The subset mounting bracket 64 also has an inwardly extending tab 64*a*. The subseat 62 is directly connected to the backrest 40 with a generally straight connecting link 54. The connecting link 54 is pivotally connected at one end with the backrest bracket 42 at a pivot 56 and at its opposite end to the subseat bracket 58 at a pivot 60 located at a front portion of the subseat bracket 58 (see FIG. 1).

Figure 5:
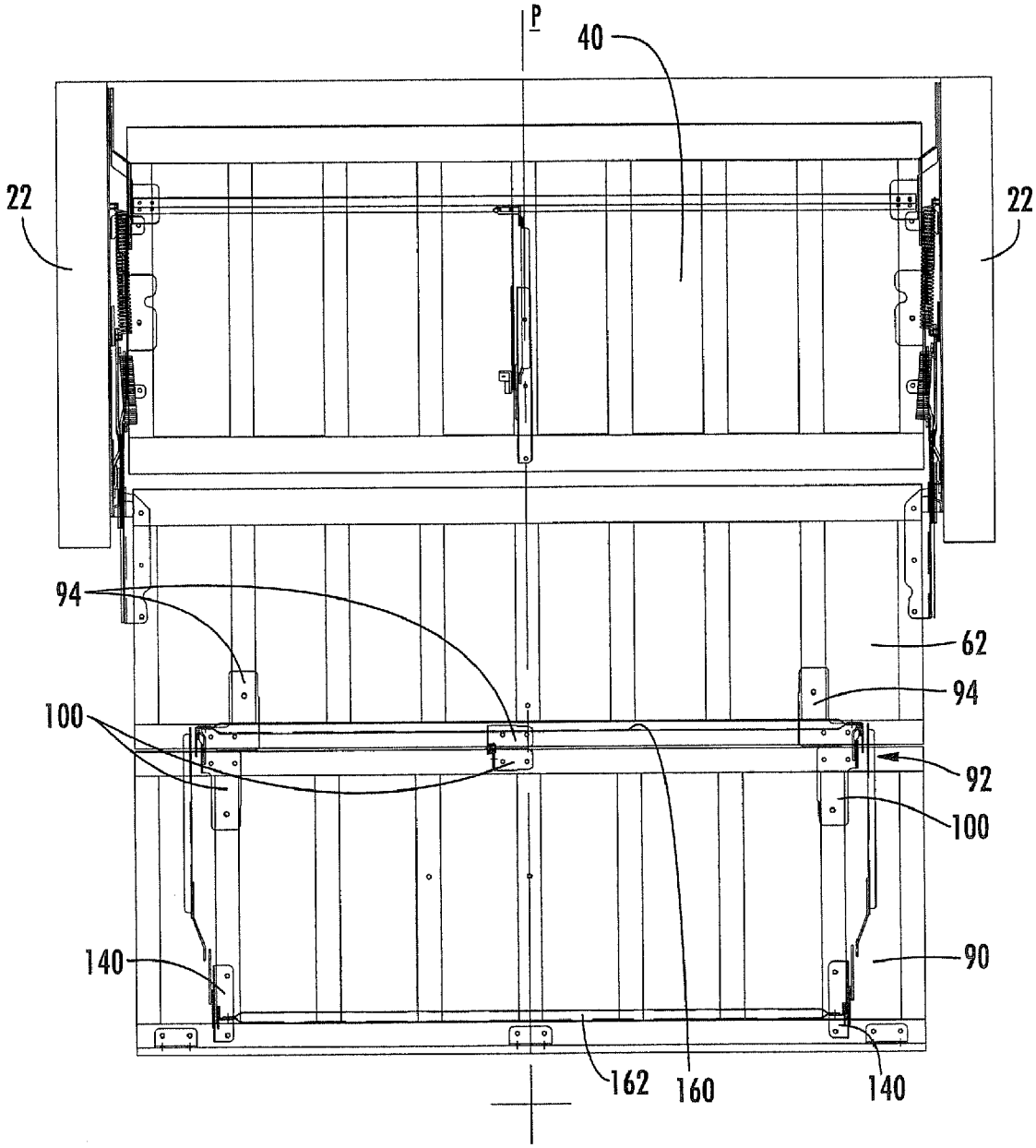
FIG. 5 is a top view of the sofa-bed of FIG. 1 shown in the unfolded position.

Still referring to FIG. 1 and also referring to FIG. 5, the seat 90 is pivotally interconnected with the subseat 62 at a hinge 92. The hinge 92 includes three pairs of subseat plates 94 and seat plates 100 (only one of each of which is shown in FIG. 1) that are spaced transversely across the sofa-bed 20. Each subseat plate 94 includes a horizontal panel and a vertical panel; similarly, the seat plates 100 include a horizontal panel and a vertical panel. Each of the subseat plates 94 is pivotally interconnected with its respective seat plate 100 at a pivot 106 that is located in and attaches the vertical panels.

Figure 3:
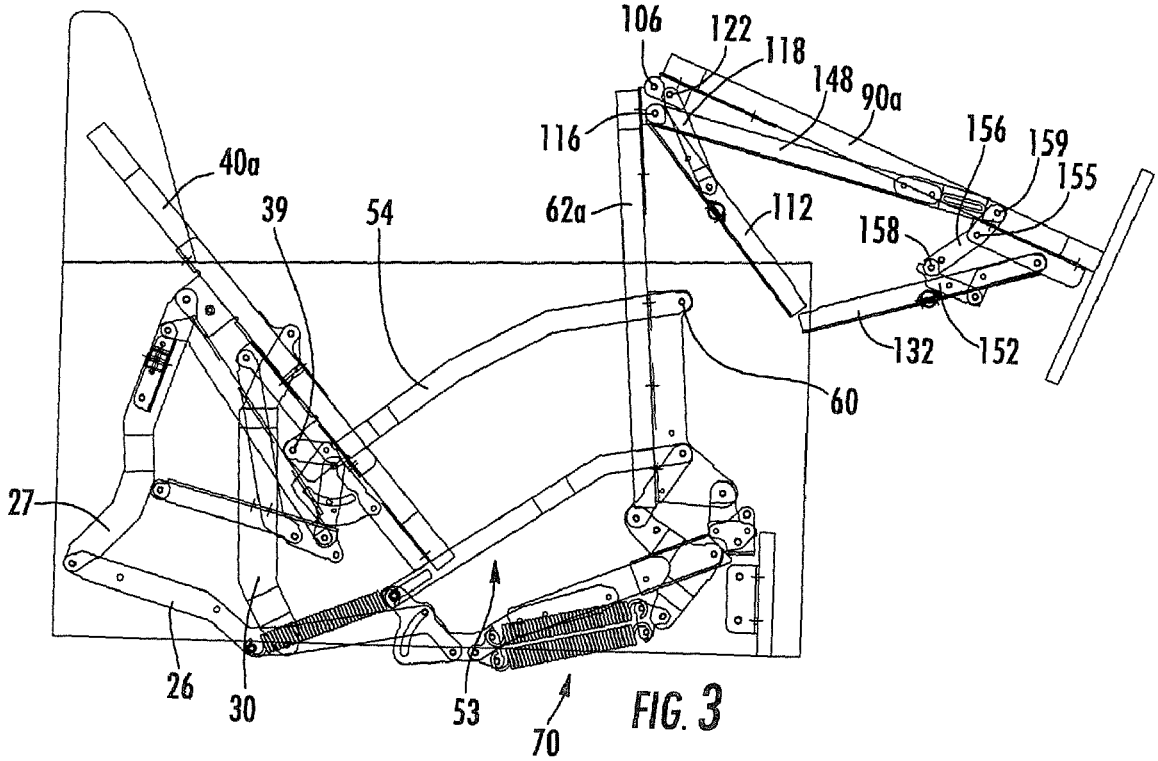
FIG. 3 is a side view of the sofa-bed of FIG. 1, with the sofa-bed shown continuing to move from the position of FIG. 2 toward the folded position.

To move the sofa bed 20 from the unfolded position of FIG. 1 to the folded position of FIG. 3, the operator lifts the foot end of the seat 90. This action causes the seat 90 to rise, which in turn causes the subseat 62 to rotate upwardly and rearwardly about the pivot 66 (counterclockwise from the vantage point of FIG. 1). This action also causes the seat 90 and subseat 62 to rotate relative to one another about the pivot 106. This action continues (see FIGS. 2 and 3 for intermediate positions) until the subseat 62 is inverted and underlies the seat 90 in the manner shown in FIG. 4. The movement of the subseat 62, and in turn the subseat bracket 58, drives the connecting link 54 rearwardly. This action forces the forward end of the backrest 40 rearwardly, which in turn drives the rear end of the backrest 40 upwardly, movement of the backrest 40 being controlled by the front and rear swing links 30, 27.

Also, referring to FIGS. 6-9, as the sofa-bed 20 moves from the unfolded to the folded position, the movement of the front swing link 27 draws the coupling link 35 upwardly and rearwardly and causes it to rotate clockwise. This action forces the upper leg segment 43 counterclockwise relative to the bracket 42. Rotation of the upper leg segment 43 causes the lower leg segment 45 to pivot about the pivot 46 and "fold back" on the upper leg segment 43, such that the wheel 45*a* extends toward the top end of the backrest panel 40*a* (see FIGS. 7 and 8). In the folded position, the upper and lower leg segments 43, 45 are generally parallel with the backrest panel 40*a* (see FIG. 9), and the pin 43*a* has moved to the opposite end of the slot 42*a*.

Those skilled in this art will appreciate that, although a two piece rear leg is shown herein, in some embodiments a one-piece rear leg may be preferable. Also, in other embodiments the rear leg may be omitted entirely.

The backrest mechanism 24 may be used with any style of sofa-bed, but is particularly suitable for use with a sectional sofa, as the links of the backrest mechanism 24 are positioned behind the backrest cushion 41 and the connecting link 54 is below the seat cushion 91 when the sofa-bed is in the folded position.

To move the folded sofa-bed 20 back to the unfolded position of FIG. 1, the operator can lift on the front edge of the seat 90. Doing so causes the subseat 62 to rotate about the pivot 66 and to move forwardly. The movement of the subseat 62 draws the connecting link 54, and in turn the backrest 40, forwardly, with the backrest 40 also rotating as controlled by the front and rear swing links 30, 27 (see FIGS. 2 and 3). The movement ceases when the rear edge of the front swing link 30 contacts a pin 40*e* on the bracket 40*b*.

Referring again to FIG. 1 and also to FIG. 6, an extension-assist mechanism 70 is interconnected with the subseat 62 to provide assistance in the unfolding of the sofa-bed 20, as some of the components can be quite heavy. The extension-assist mechanism 70 includes a drawing link 72, which is pivotally interconnected at one end to the subseat bracket 58 at a pivot 74; at its opposite end, the drawing link 72 is pivotally interconnected to one end of a L-shaped crank 76 at a pivot 78. The crank 76 is pivotally interconnected at its vertex to the subseat mounting bracket 64 at a pivot 80. The opposite end of the crank 76 is attached to a spring extension 83 at a pivot 85. The spring extension 83 includes two pins 83*a*, 83*b*. Two springs 82*a*, 82*b* are attached between, on the one hand, the pins 29*a*, 29*b* and, on the other hand, the pins 83*a*, 83*b*.

In the unfolded position illustrated in FIGS. 1 and 6, the drawing link 72 extends rearwardly and slightly downwardly from the pivot 74 to the pivot 78. The crank 76 extends downwardly from the pivot 78 to the pivot 80, then rearwardly to attach to the forward ends of the springs 82*a*, 82*b*. The springs 82*a*, 82*b* extend rearwardly and downwardly from the pin 83*a*, 83*b* to the pin 29*a*, 29*b* and are slightly in tension (preferably about 10 pounds of tension is provided by the combination of the springs 82*a*, 82*b* on each side of the sofa-bed 20). Tension in the springs 82*a*, 82*b* slightly urges the sofa-bed 20 to remain in the unfolded position of FIG. 1.

Referring again to FIG. 6, a folding-assist mechanism 53 is interconnected with the subseat 62 to assist with the folding of the sofa-bed 20. The folding assist-mechanism 53 includes an extension link 49, which is attached at one end to the subseat bracket 58 at the pivot 74. The extension link 49 extends rearwardly and slightly downwardly from the pivot 74. A sequence plate 50 is attached to the mounting bracket 26 at a pivot 51. The sequence plate 50 includes a pin 50*b* that is received in a slot 49*a* in the extension link 49. The sequence plate 50 also includes a slot 50*a* that receives the pin 26*a* mounted on the mounting bracket 26. A spring 48 extends between the pin 29*c* mounted on the mounting bracket 26 and the pin 50*b*.

In the unfolded position of FIGS. 1 and 6, the spring 48 is in considerable tension. As such, the spring 48 draws the pin

50*b* of the sequence plate 50 to the rear end of the slot 49*a* of the extension link 49. The forward rotation of the sequence plate 50 is limited by the rearward position of the pin 26*a* in the slot 50*a*.

Figure 7:
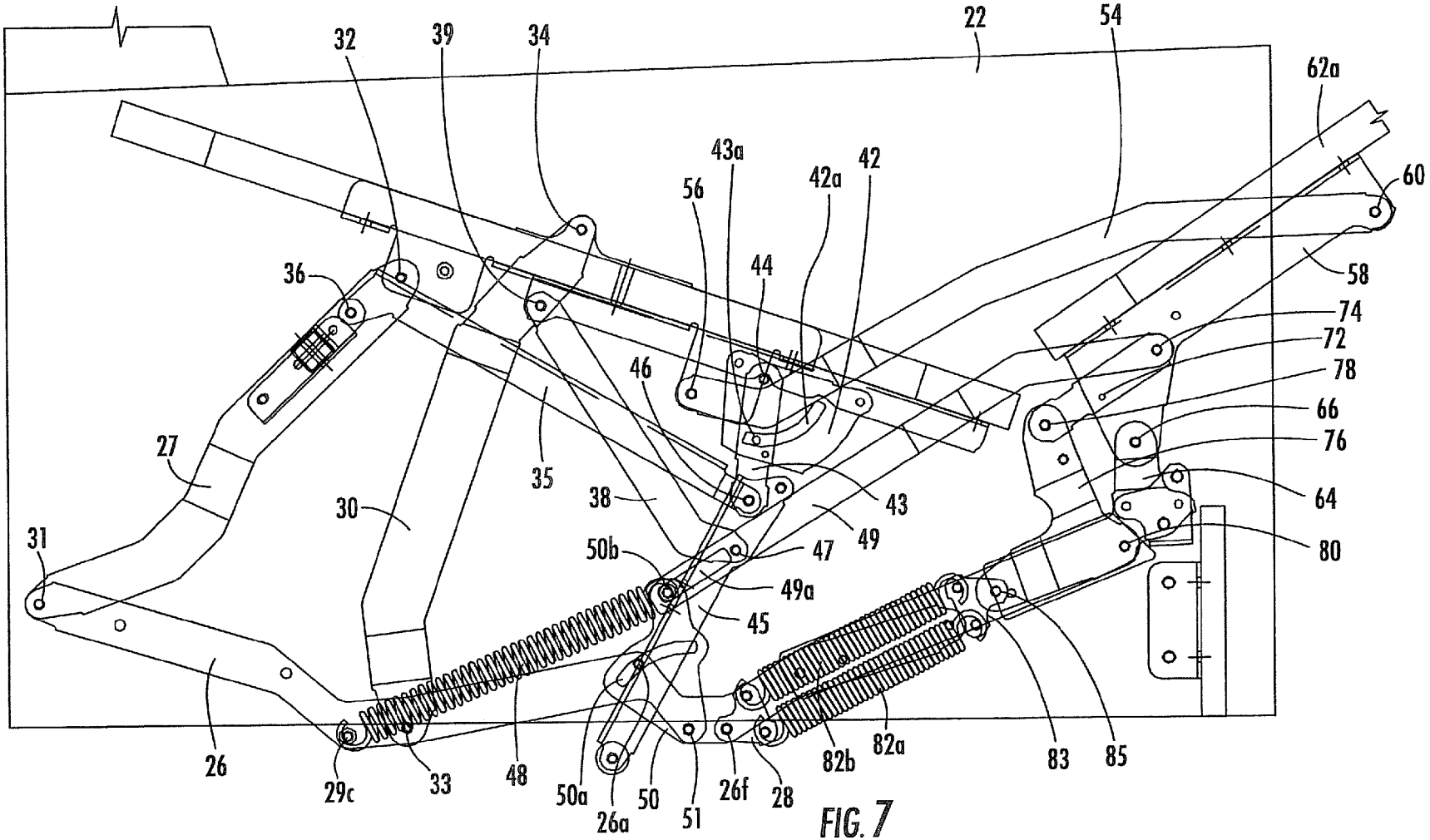
FIG. 7 is an enlarged side view of the sofa-bed of FIG. 1 shown moving from the unfolded position toward the folded position.
Figure 8:
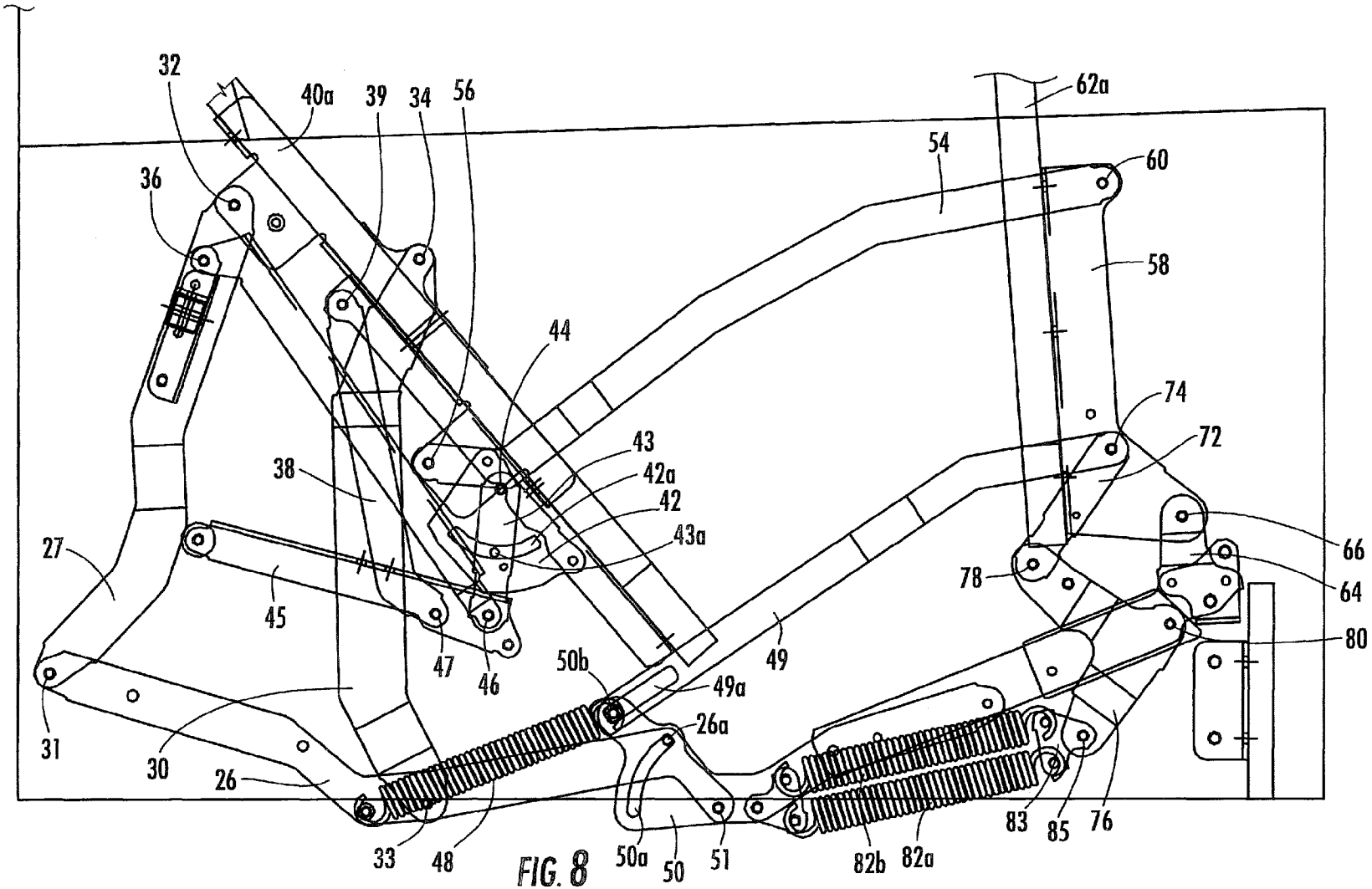
FIG. 8 is an enlarged side view of the sofa-bed of FIG. 1 shown continuing to move from the position of FIG. 7 toward the folded position.

The assistance provided by the extension-assist mechanism 70 and the folding-assist mechanism 53 can be seen in FIGS. 6-9. In the unfolded position of FIG. 6, the spring 48 of the folding-assist mechanism 53 is in tension. As the sofa-bed 20 moves toward the folded position of FIGS. 4 and 9, the subseat bracket 58 forces the extension link 49 rearwardly. Tension in the spring 48 maintains the pin 50*b* in the rear end of the slot 49*a*, such that the sequence plate 50 rotates counterclockwise (FIG. 7). Tension in the spring 48 also assists the operator in folding the sofa-bed 20 (i.e., the spring 48 biases the sofa-bed 20 toward the folded position). The rotation of the sequence plate 50 continues until the rear end of the slot 50*a* reaches the pin 26*a* (see FIG. 8). In the intermediate position of FIG. 8, the tension in the spring 48 is substantially absent, such that the folding-assist mechanism 53 ceases to bias the sofa-bed toward the folded position of FIG. 9. At this point, continued movement of the subseat 62 toward the folded position causes the extension link 49 to move rearwardly such that the pin 50*b* moves toward the front end of the slot 49*a* (FIG. 9); during this movement, tension is absent in the spring 48.

Figure 4:
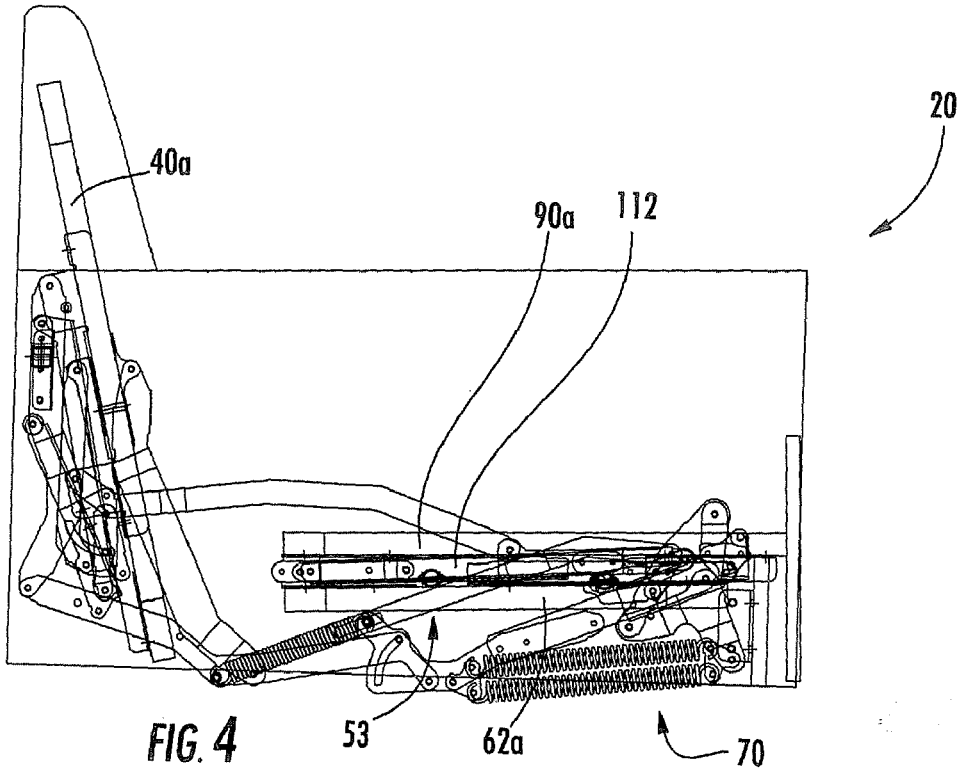
FIG. 4 is a side view of the sofa-bed of FIG. 1 shown in its folded position.
Figure 9:
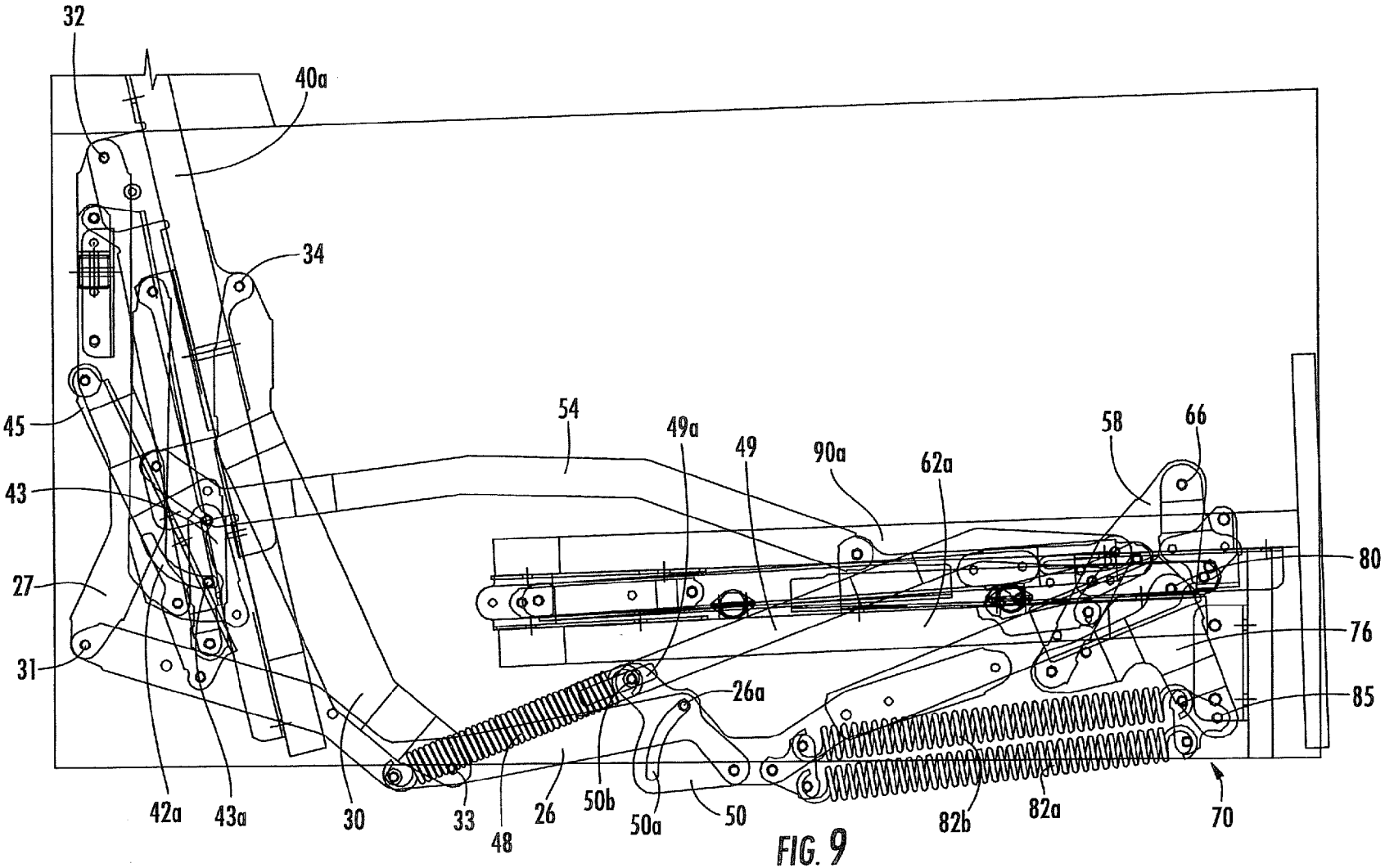
FIG. 9 is an enlarged side view of the sofa-bed of FIG. 1 shown in its folded position.

In addition, as the sofa-bed 20 moves to the folded position of FIGS. 4 and 9, as described above, the subseat 62 is moving rearwardly and rotating to an inverted position. This movement of the subseat 62 drives the drawing link 72 rearwardly and causes the crank 76 to rotate counterclockwise. The movement and rotation of the drawing link 72 drives the crank 76 counterclockwise about the pivot 80. As the crank 76 rotates, it induces the springs 82*a*, 82*b* to continue to stretch (particularly after the sofa-bed 20 reaches the intermediate position shown in FIG. 8), thereby providing increasing resistance to the rotation of the subseat 62 (i.e., the springs 82*a*, 82*b* bias the seat 90 and subseat 62 toward the unfolded position). This resistance can help to control the lowering of the seat 90 and subseat 62 into the frame of the sofa-bed 20, which may be desirable, as the seat 90 and subseat 62 can be quite heavy. In addition, the considerable tension in the springs 82*a*, 82*b* (preferably between about 120 and 160 pounds in the folded position) can also assist the operator in raising the seat 90 and subseat 62 from the frame to move the sofa-bed 20 into the unfolded position of FIGS. 1 and 6. Thus, the configuration of the extension-assist mechanism 70 can provide assistance to unfolding while enabling the seat 90 and subseat 62 to remain in the folded position when unfolding is not desired.

Those skilled in this art will appreciate that the folding-assist mechanism 53 and the extension-assist mechanism 70 may take other configurations. For example, the shapes of the links comprising the mechanisms 53, 70 may be modified, as may the number of links or their interconnection relationship. Also, the folding-assist mechanism 53 may discontinue biasing the sofa-bed 20 toward the folded position at a first intermediate position, and the extension-assist mechanism 70 may initiate biasing toward the unfolded position at a second, different intermediate position. Moreover, either or both of the folding-assist mechanism 53 and the extension-assist mechanism 70 may be omitted in some embodiments.

It can also be seen that, in the unfolded position of FIG. 1, the subseat 62 and seat 90 are supported from below by legs 112, 132. As can be seen in the folded position of FIG. 4, the legs 112, 132 fold into positions between the seat 90 and the subseat 62. The movement of the legs 112, 132 is controlled by a center leg mechanism 110 and an end leg mechanism 130, which together comprise a leg-folding mechanism 111. These are described in detail below.

Referring to FIGS. 1 and 5, the center leg mechanism 110 includes a brace 118, which is pivotally interconnected at one end to the vertical panel of the seat plate 100 at a pivot 122 that is located forwardly of the pivot 106, and at the other end at a pivot 120 to a flange 114 which extends upwardly from the leg 112. The flange 114 terminates at a pivot 116 with the vertical panel of the subseat plate 94. Thus, a four-bar linkage is defined between the brace 118, the flange 114, the subseat plate 94, and the seat plate 100. The pivots 116, 106 and 122 are generally horizontally aligned when the sofa-bed 20 is in the unfolded position.

Still referring to FIG. 1, the end leg mechanism 130 includes a flange 134 that is fixed to the upper end of the leg 132. The flange 134, which includes a tab 134*a*, is attached at a pivot 144 to a seat bracket 136 that has a vertical panel 138 and a horizontal panel 140. The horizontal panel 140 of the seat bracket supports the panel 90*a* of the seat 90 from underneath. The tab 134*a* is interconnected with a control link 152 at a pivot 154; the control link 152 is connected at its opposite end to a drive link 156 at a pivot 158. The drive link 156 is also pivotally attached to the rear end of a crank 150 at a pivot 159 and to the seat bracket 136 at a pivot 155. A connecting tube 148 is fixed to the rearward end of the crank 150 and also is pivotally connected to the vertical panel of the subseat plate 94 at the pivot 116.

Referring still to FIG. 1, the legs 112 on either side of the sofa bed 20 are interconnected via a cross tube 160 (which extends between upper portions of each leg 112) and the legs 132 on either side of the bed are connected via a cross tube 162 (which extends between upper portions of each leg 132). The cross tubes 160, 162 assist in synchronizing the motion of the legs and in providing stability to the sofa-bed 20 when it is in the unfolded position.

As noted above, to move the sofa bed 20 from the unfolded position of FIG. 1 to the folded position of FIG. 4, the operator lifts on the foot end of the seat 90. This action causes the seat 90 to rise, which in turn causes the subseat 62 to rotate upwardly and rearwardly about the pivot 66 and causes the seat 90 and subseat 62 to rotate relative to one another about the pivot 106. As the relative rotation of the seat 90 and subseat 62 continues, the subseat plate 94 rotates with the subseat 62. The action of the subseat plate 94 drives the lower end of the flange 114 forwardly and upwardly; also, the lower end of the brace 118 is driven upwardly and forwardly. The movement of the flange 114 draws the leg 112 from its generally upright orientation toward the underside of the seat 90. This action is completed when the leg 112 folds completely under the seat 90 and is generally horizontally disposed and sandwiched between the seat 90 and subseat 62 (see FIGS. 4 and 5).

In addition, the pivoting of the subseat 62 relative to the seat 90 drives the connecting tube 148 and crank 150 forwardly toward the foot end of the seat 90. This action causes the drive link 156 to rotate clockwise about the pivot 155. This rotation draws the lower end of the control link 152 downwardly relative to the leg 132, which in turn causes the leg 132 to rotate clockwise relative to the seat bracket 136 and toward the lower surface of the seat panel 91. This action continues until the subseat 62 is inverted and positioned below the seat 90 (see FIGS. 4 and 9). The center legs 112 and the end legs 132 define a substantially horizontal plane, with the end legs 132 being positioned inboard of the center legs 112.

When the sofa-bed 20 is returned to the unfolded position, the movements described herein for the center leg mechanism 110 and the end leg mechanism 130 are reversed. Movement of the legs 112, 132 ceases when a tab on the control link 152 contacts a pin 150*a* on the drive link 156 (which should coincide with front swing link 30 striking the pin 40*e*).

Those skilled in this art will recognize that other leg mechanisms may also be suitable for use with sofa-beds of the present invention. For example, the shapes and pivot points of members thereof may be modified, or links may be added or omitted as desired.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A foldable sofa-bed, comprising:

a frame with opposed arms;

a backrest operatively connected to the frame;

a seat;

a subseat hinged to the seat and pivotable relative thereto;

a backrest mechanism attached to the frame and to the backrest, wherein the backrest mechanism includes front and rear swing links, each of the front and rear swing links being pivotally interconnected with the frame and the backrest;

an extension-assist mechanism attached to the frame and the subseat, wherein the extension-assist mechanism includes at least one spring, a crank that is pivotally attached with the frame and with the spring, and a drawing link that is pivotally attached to the subseat and to the crank; and a folding-assist mechanism attached to the frame at which the backrest mechanism is attached and attached to the subseat, wherein the folding-assist mechanism includes at least one spring, and an extension link pivotally attached to the subseat and to the at least one spring of the folding-assist mechanism;

wherein the frame, backrest, seat and subseat are configured to move between a folded position, in which the backrest is generally upright, the seat is generally horizontal, and the subseat is generally horizontal and positioned beneath the seat in a first inverted orientation, and an unfolded position, in which the backrest, subseat and seat are generally horizontal, and the subseat is positioned between the backrest and the seat in a second non-inverted orientation;

wherein the folding-assist mechanism is configured such that the sofa-bed is biased toward the folded position as the sofa-bed moves from the unfolded position toward a first intermediate position; and wherein the extension-assist mechanism is configured such that the sofa-bed is biased toward the unfolded position as the sofa-bed moves from a second intermediate position toward the folded position.

2. The sofa-bed defined in claim 1, wherein the first and the second intermediate positions are substantially coincident.

3. The sofa-bed defined in claim 1, wherein the folding-assist mechanism further comprises a sequence plate attached to the frame and to the extension link, the sequence plate configured to allow the folding-assist mechanism to bias movement of the sofa-bed toward the folded position as the sofa-bed moves from the unfolded position to the first intermediate position, but to prevent the folding-assist mechanism from biasing movement of the sofa-bed as the sofa-bed moves from the first intermediate position to the folded position.

4. The sofa-bed defined in claim 3, wherein the sequence plate includes a slot, and wherein a pin fixed relative to the frame is received within the sequence plate slot.

5. The sofa-bed defined in claim 3, wherein the extension link includes a slot that receives a pin attached to the sequence plate.

6. The sofa-bed defined in claim 1, wherein the extension link and the drawing link attach to the subseat at a common pivot.

7. A foldable sofa-bed, comprising:

a frame with opposed arms;

a backrest operatively connected to the frame;

a seat;

a subseat hinged to the seat and pivotable relative thereto;

a backrest mechanism attached to the frame and to the backrest, wherein the backrest mechanism includes front and rear swing links, each of the front and rear swing links being pivotally interconnected with the frame and the backrest; and a rear leg pivotally interconnected with the backrest, said rear leg having upper and lower segments interconnected at a first pivot, and wherein the upper segment of the rear leg is pivotally attached with the backrest;

wherein the frame, backrest, seat and subseat are configured to move between a folded position, in which the backrest is generally upright, the seat is generally horizontal, and the subseat is generally horizontal and positioned beneath the seat in a first inverted orientation, and an unfolded position, in which the backrest, subseat and seat are generally horizontal, and the subseat is positioned between the backrest and the seat in a second non-inverted orientation;

wherein the rear leg is foldable between a folded position generally parallel with the backrest when the sofa-bed is in its folded position and an unfolded position generally perpendicular to the backrest when the sofa-bed is in its unfolded position; and wherein the backrest mechanism further comprises a coupling link that is pivotally interconnected with the front swing link and the upper segment, and a brace that is pivotally interconnected with the backrest and the lower segment.

8. The sofa-bed defined in claim 7, wherein the backrest mechanism further comprises a rear leg bracket fixed to the backrest, and wherein the upper segment is pivotally attached to the rear leg bracket, and wherein the upper segment includes a pin that is received in a slot in the rear leg bracket.

9. The sofa-bed defined in claim 7, wherein when the backrest, seat and subseat are in the folded position, the upper and lower segments of the rear leg are folded back upon each other.

10. The sofa-bed defined in claim 7, wherein the upper segment, the lower segment, and the coupling link are attached at a common point.

11. The sofa-bed defined in claim 7, wherein the sofa-bed is a sectional sofa-bed.

12. A foldable sofa-bed, comprising: a frame with opposed arms; a backrest operatively connected to the frame; a seat; a subseat hinged to the seat and pivotable relative thereto; and a backrest mechanism attached to the frame and to the backrest; wherein the frame, backrest, seat and subseat are configured to move between a folded position, in which the backrest is generally upright, the seat is generally horizontal, and the subseat is generally horizontal and positioned beneath the seat in a first inverted orientation, and an unfolded position, in which the backrest, subseat and seat are generally horizontal, and the subseat is positioned between the backrest and the seat in a second non-inverted orientation; and wherein the backrest mechanism includes a rear leg pivotally interconnected with the backrest and foldable between a folded position generally parallel with the backrest when the sofa-bed is in its folded position and an unfolded position generally perpendicular to and below the backrest when the sofa-bed is in its unfolded position.

13. The sofa-bed defined in claim 12, wherein the rear leg comprises upper and lower segments interconnected at a first pivot.

14. The sofa-bed defined in claim 13, wherein the upper segment is pivotally attached with the backrest, and wherein the backrest mechanism further comprises a coupling link that is pivotally interconnected with the upper segment, and a brace that is pivotally interconnected with the backrest and the lower segment.

15. The sofa-bed defined in claim 13, wherein the backrest mechanism further comprises a rear leg bracket fixed to the backrest, and wherein the upper segment is pivotally attached to the rear leg bracket, and wherein the upper segment includes a pin that is received in a slot in the rear leg bracket.

16. The sofa-bed defined in claim 13, wherein when the backrest, seat and subseat are in the folded position, the upper and lower segments of the rear leg are folded back upon each other.

17. The sofa-bed defined in claim 14, wherein the upper segment, the lower segment, and the coupling link are attached at a common point.

* * * * *